US005124225A

United States Patent [19]

Shibata

[11] Patent Number: 5,124,225

[45] Date of Patent: Jun. 23, 1992

[54] TONER FOR DEVELOPING STATIC CHARGE IMAGES

[75] Inventor: Kohsei Shibata, Shizuoka, Japan

[73] Assignee: Tomoegawa Paper Co., Ltd., Tokyo, Japan

[21] Appl. No.: 550,571

[22] Filed: Jul. 10, 1990

[30] Foreign Application Priority Data

Sep. 5, 1989 [JP] Japan ..... 1-228418

[51] Int. Cl.[5] ..... G03G 9/00

[52] U.S. Cl. ..... 430/110; 430/109; 430/904

[58] Field of Search ..... 430/109, 110, 904

[56] References Cited

U.S. PATENT DOCUMENTS

| | | | |
|---|---|---|---|
| 4,535,049 | 8/1985 | Honda et al. | 430/137 |
| 4,556,624 | 12/1985 | Gruber et al. | 430/110 |
| 4,824,553 | 4/1989 | Rueff | 208/32 |
| 4,851,045 | 7/1989 | Taniguchi | 523/160 X |

FOREIGN PATENT DOCUMENTS 3502748 8/1985 Fed. Rep. of Germany .

OTHER PUBLICATIONS

Patent Abstracts of Japan vol. 9, No. 30 (P-333) (1753) 8 Feb. 1985 (Tomoegawa Seishijiyo K.K.) 3 Oct. 1984 & JP-A-59 174 852.

Patent Abstracts of Japan vol. 13, No. 351 (P-912) (3699) 7 Aug. 1989 (Ricoh Co., Ltd.) 26 Apr. 1989 & JP-A-1 109 360.

*Primary Examiner*—Marion E. McCamish
*Assistant Examiner*—S. Crossan
*Attorney, Agent, or Firm*—Oblon, Spivak, McClelland, Maier & Neustadt

[57] ABSTRACT

A toner for developing static charge images is disclosed which comprises 1 to 15 parts by weight of waxes whose DSC heat absorption regions exist only at a temperature no lower than 50° C. and 100 parts by weight of a binder resin. As for such waxes, there can be used waxes which have been purified by removing fatty acids whose DSC heat absorption regions exist at temperatures no higher than 50° C.

7 Claims, 1 Drawing Sheet

TONER FOR DEVELOPING STATIC CHARGE IMAGES

BACKGROUND OF THE INVENTION

1. Field of the Invention

The present invention relates to a dry toner for developing static charge images formed by electrophotography, electrostatic printing method, electrostatic recording method, and the like.

2. Description of Related Arts

Various techniques have heretofore been used in order to improve fixing strength at low temperatures for fixing toners for developing static charge images for copiers and printers. Investigation has been made mainly on binder resins in the toners for developing static charge images.

For example, there have been used a method in which the distribution of the molecular weight of the binder toner is broadened and a method in which high molecular weight parts of the binder resin are crosslinked. However, these methods have problems that it is inevitable to decrease the glass transition temperature of the toner in order to maintain the fixing strength of the binder resin at a sufficient level, which deteriorates the storage stability of toners for developing static charge images containing it, and that it is difficult to give the toner a sufficient fixing strength even when it is tried to improve the fixing strength while maintaining its storage stability at the same level.

Another method has been proposed, in which a small amount of an auxiliary resin that is highly crystalline and has a low melt viscosity is added to the binder resin which is a main component of the toner for developing static charge images, thereby increasing improving the fixing strength of the toner. Although this method gives rise to good results with respect to the fixing strength of the toner and the storage stability of the toner due to the highly crystalline auxiliary resin added without decreasing the glass transition temperature, the melt viscosity of the toner at the time of hot roll fixing decreases abruptly and a phenomenon of off-set tends to occur due to weak aggregation of the toner while it is molten. In order to obviate the above-described problems, it has been proposed to add a highly crystalline polyolefin or natural wax which has a sharp melt viscosity characteristics to the toner. However, the polyolefin wax has a problem that carbon, charge control agent and the like which are to be dispersed in the toner for developing static charge images are difficult to be dispersed, resulting in that it is difficult to obtain a uniform toner for developing static charge images. On the other hand, natural wax has a problem that its static stability, environmental characteristics and particularly storage stability deteriorate remarkably.

SUMMARY OF THE INVENTION

The present invention has been accomplished with reference to the above-described problems and an object of the present invention is to provide a toner for developing static charge images which has a high fixing strength at low temperatures and superior electrostatic stability at extreme environmental conditions such as high temperature and high humidity or low temperature and low humidity, and which rarely causes blocking and thus exhibits excellent storage stability.

Therefore, in one aspect, the present invention is directed to a toner for developing static charge images, comprising 1 to 15 parts by weight of waxes whose heat absorption region measured by using a differential scanning calorimeter exists only at a temperature no lower than 50° C. and 100 parts by weight of a binder resin.

In another aspect, the present invention is directed to a toner for developing static charge images, comprising 1 to 15 parts by weight of waxes which have been purified by removing fatty acids whose heat absorption regions measured by using a differential scanning calorimeter exist at temperatures no higher than 50° C. and 100 parts by weight of a binder resin.

The toner for developing static charge images of the present invention has a high fixing strength at low temperatures and a friction charge characteristics which is not influenced by environmental conditions and does cause no problem in the storage stability.

The above and other objects, effects, features and advantages of the present invention will become more apparent from the following description of embodiments thereof taken in conjunction with the accompanying drawing.

DETAILED DESCRIPTION OF THE INVENTION

Figure 1:
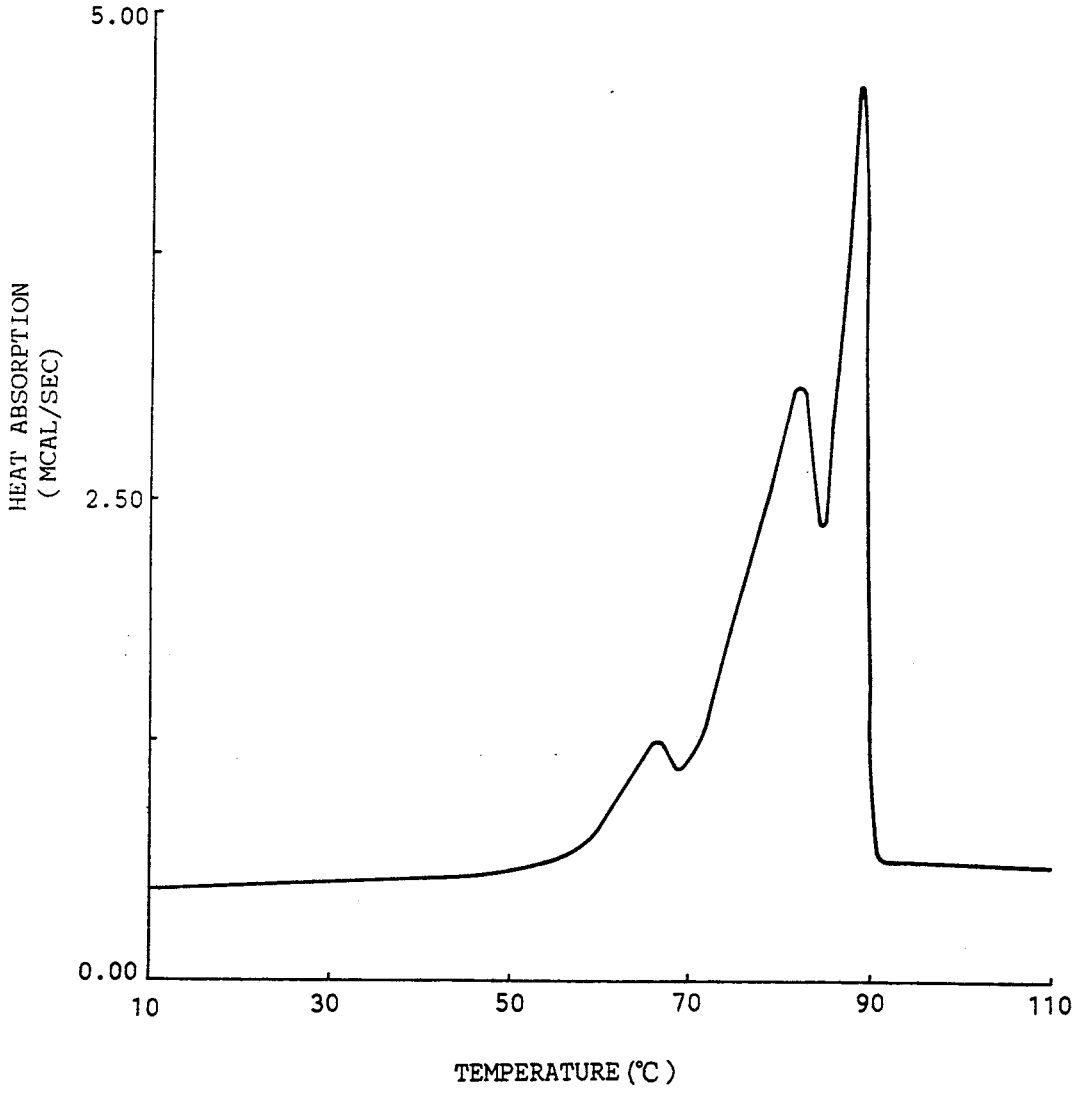
FIG. 1 is a graph showing results of measurement on a wax whose DSC heat absorption region exists only at a temperature no lower than 50° C.

Heat absorption region measured by using a differential scanning calorimeter is referred to herein as "DSC heat absorption region" for brevity.

The term "waxes" as used herein refers to esters between fatty acids and higher monohydric or dihydric alcohols which are insoluble in water, that is, natural waxes composed of vegetable waxes obtained from plant bodies such as trees and animal waxes derived from animal bodies and semi-synthetic waxes which have been purified by removing those fatty acids whose DSC heat absorption regions exist at a temperature not higher than 50° C.

Examples of the natural waxes include castor wax produced by ITOH SEIYU CO., LTD. and Carnauba wax produced by NODA WAX CO., LTD.

The fatty acids whose DSC heat absorption region is at a temperature not higher than 50° C. include, for example, stearic acid and palmitic acid. The natural waxes and semi-synthetic waxes contain such fatty acids singly or as a mixture, and the waxes are purified by removing the or each fatty acid by the following method before they can be applied to the toner for developing static charge images according to the present invention.

According to the purification method according to the present invention, at first 10 to 25 parts by weight of natural wax or a semi-synthetic wax is completely dissolved in 100 parts by weight of a suitable solvent while heating. Then, the resulting solution is cooled to a temperature near 40° C. According as it is cooled, a high melting point fatty acid, the objective substance, precipitates, which is then removed. The above-described procedure is repeated a plurality of times until a desired purity can be attained. Examples of the solvent which can be used in the above-described purification method include methyl isobutyl ketone, methyl ethyl ketone, isopropyl alcohol and n-hexane.

FIG. 1 shows results of measurement on a wax obtained by the purification of the castor wax produced by ITOH SEIYU CO., LTD. by removing undesirable fatty acids therefrom using the above-described method as an example of the waxes whose DSC heat absorption region exist only at a temperature no lower than 50° C. which is used in the present invention. As shown in FIG. 1, the waxes used in the present invention show no peak of heat absorption at a temperature no higher than 50° C. This indicates that no heat absorption occurs in that region.

In the present invention, the waxes whose DSC heat absorption regions exist only at a temperature no lower than 50° C. are added to the toner for developing static charge images in an amount of, suitably, from 1 to 15 parts by weight and 100 parts by weight of the binder resin. If the amount of the waxes to be added is below 1 part by weight, increase in the fixing strength is not so high and on the other hand, if it is more than 15 parts by weight, undesirable phenomenon such as too lustrous transferred image occurs, which leads to decrease of the quality of images.

The toner for developing static charge images according to the present invention comprises a binder resin, a colorant and other additives in addition to the waxes whose DSC heat absorption regions exist only at a temperature no lower than 50° C. It can be obtained by mixing these materials in desired proportions, meltkneading them followed by pulverizing and classifying.

The binder resin includes, for example, polystyrene, styrene/acrylies, polyacrylate, polyethylene, styrene/-butadiene copolymer, polyamide, polyvinyl chloride, vinyl chloride/vinyl acetate copolymer, coumarone/indene resin and polyester. The styrene acrylics is a coplymer comprising at least one monomer selected from each of the styrene monomer group and acrylic monomer group as described in more detail below. The styrene monomer group comprises monomers such as styrene, o-methylstyrene, m-methylstyrene, p-methylstyrene, α-methylstyrene, p-ethylstyrene, 2,4-dimethylstyrene, p-n-buthylstyrene, p-tert-buthylstyrene p-n-hexylstyrene, p-n-octhylstyrene, p-n-nonylstyrene, p-n-decylstyrene, p-n-dodecylstyrene, p-methoxylstyrene, p-phenylstyrene, p-chlorostyrene, and 3,4-dichlorostyrene; the acrylic monomer comprises unsaturated mono-olefins such as ethylene, propylene, butylene an isobutylene; vinyl esters such as vinyl chloride, vinyl bromide, vinyl fluoride, vinyl acetate, vinyl propionate, vinyl benzoate and vinyl butyrate; α-methylene aliphatic monocarboxylic acid esters such as methyl acrylate, ethyl acrylate, ethyl acrylate, n-butyl acrylate, isobutyl acrylate, propyl aceylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, isobutyl methacrylate, isobutyl methacrylate, n-octyl methacrylate, dodecyl methacrylate, lauryl methacrylate, 2-ethylhexyl methyacrylate, stearyl methacrylate, phenyl methacrylate, dimethylaminoethyl methacrylate and diethylaminoethyl methacrylate; acrylic acid and methacrylic acid derivatives such as acrylionitrile, methacrylonitrile and acrylamide; vinyl ethers such as vinulmethyl ether, vinylethyl ether and vinulisobutyl ether; vinyl ketones such as vinylmethyl ketone, vinylhexyl ketone and methylisopropenyl ketone; and N-vinyl compounds such as N-vinylpyrrole, N-vinylcarbazole, N-vinylindole and N-vinylpyrrolidine. The colorant includes pigments and dyes which are used usually as a colorant for toners for developing static charge images. Examples thereof include carbon black, nigrosine dye, aniline dye, Chrome Yellow, Ultramarine Blue, Methylene Blue Chloride, Rose Bengale, magnetite and ferrite. If desired, various auxiliaries can be used as the other additives. Examples thereof include charge control agents, antioxidants, pigments, and flowability improving agents such as colloidal silica and colloidal alumina.

EXAMPLES

Next, the present invention will be explained with reference to examples. In the examples, all parts are by weight.

EXAMPLE 1

| | |
|---|---|
| Styrene/n-butyl acrylate/methgl methacrylate copolymer (Mn = 4,000, Mw = 124,000, Mw/Mn = 31.0) | 100 parts |
| Quaternary ammonium salt ("BONTRON P-51", produced by Orient Chemical Industrial Co., Ltd.) | 2 parts |
| Carbon black ("CARBON BLACK #40", produced by Mitsubishi Chemical Industries Co., Ltd.) | 5 parts |
| Polypropylene ("VISCOL 550P", produced by Sanyo Chemical Industries Co., LTD.) | 3 parts |

The material of the above-described composition was mixed with 15 parts of purified castor wax which had been obtained by the purification of castor wax produced by ITOH SEIYU CO., LTD. by removing therefrom fatty acids whose DSC heat absorption regions existed at a temperature no higher than 50° C., and the resulting mixture was melt-kneaded using an extruder, pulverized by using a hammer mill and at a jet mill, and classified using an air-stream classifier so as to have a mean particle size of 12 μm to obtain a toner for developing static charge images according to the present invention.

EXAMPLE 2

| | |
|---|---|
| Polyester (Mn = 4,000, Mw = 200,000, Mw/Mn = 50) | 100 parts |
| Quaternary ammonium salt ("BONTRON P-51", produced by Orient Chemical Industrial Co., Ltd.) | 3 parts |
| Carbon black ("CARBON BLACK #40", produced by Mitsubishi Chemical Industries Co., Ltd.) | 5 parts |
| Polypropylene ("VISCOL 550P", produced by Sanyo Chemical Industries Co., Ltd.) | 2 parts |

The material of the above-described composition was mixed with 12 parts of purified carnauba wax which had been obtained by the purification of carnauba wax produced by NODAWAX CO., LTD. by removing therefrom fatty acids whose DSC heat absorption regions existed at a temperature no higher than 50° C., and the resulting mixture was melt-kneaded using an extruder, pulverized by using a hammer mill or a jet mill, and classified using an air-stream classifier so as to have a mean particle size of 12 μm to obtain a toner for developing static charge images according to the present invention.

COMPARATIVE EXAMPLE 1

| | |
|---|---|
| Styrene/n-butyl acrylate/methgl methacrylate copolymer (Mn = 4,000, Mw = 124,000, Mw/Mn = 31.0) | 100 parts |
| Quaternary ammonium salt ("BONTRON P-51", produced by Orient Chemical Industrial Co., Ltd.) | 2 parts |
| Carbon black ("CARBON BLACK #40", produced by Mitsubishi Chemical Industries Co., Ltd.) | 5 parts |
| Polypropylene ("VISCOL 550P", produced by Sanyo Chemical Industries Co., Ltd.) | 3 parts |

The material of the above-described composition was mixed and melt-kneaded using an extruder, pulverized by using a hammer mill or a jet mill, and classified using an air-stream classifier so as to have a mean particle size of 12 μm to obtain a toner for developing static charge images for comparison.

COMPARATIVE EXAMPLE 2

| | |
|---|---|
| Styrene/n-butyl acrylate/methgl methacrylate copolymer (Mn = 4,000, Mw = 124,000, Mw/Mn = 31.0) | 100 parts |
| Quaternary ammonium salt ("BONTRON P-51", produced by Orient Chemical Industrial Co., Ltd.) | 2 parts |
| Carbon black ("CARBON BLACK #40", produced by Mitsubishi Chemical Industries Co., Ltd.) | 5 parts |
| Polypropylene ("VISCOL 550P", produced by Sanyo Chemical Industries Co., Ltd.) | 3 parts |
| Castor wax ("CASTOR WAX" produced by ITOH OIL MFG CO., LTD.) | 15 parts |

The material of the above-described composition was mixed and melt-kneaded using an extruder, pulverized by using a hammer mill or a jet mill, and classified using an air-stream classifier so as to have a mean particle size of 12 μm to obtain a toner for developing static charge images for comparison.

COMPARATIVE EXAMPLE 3

| | |
|---|---|
| Polyester (Mn = 4,000, Mw = 200,000, Mw/Mn = 50) | 100 parts |
| Quaternary ammonium salt ("BONTRON P-51", produced by Orient Chemical Industrial Co., Ltd.) | 3 parts |
| Carbon black ("CARBON BLACK #40", produced by Mitsubishi Chemical Industries Co., Ltd.) | 5 parts |
| Polypropylene ("VISCOL 550P", produced by Sanyo Chemical Industries Co., Ltd.) | 2 parts |

The material of the above-described composition was mixed and melt-kneaded using an extruder, pulverized by using a hammer mill or a jet mill, and classified using an air-stream classifier so as to have a mean particle size of 12 μm to obtain a toner for developing static charge images for comparison.

COMPARATIVE EXAMPLE 4

| | |
|---|---|
| Polyester (Mn = 4,000, Mw = 200,000, Mw/Mn = 50) | 100 parts |

-continued

| | |
|---|---|
| Quaternary ammonium salt ("BONTRON P-51", produced by Orient Chemical Industial Co., Ltd.) | 3 parts |
| Carbon black ("CARBON BLACK #40", produced by Mitsubishi Chemical Industries Co., Ltd.) | 5 parts |
| Polypropylene ("VISCOL 550P", produced by Sanyo Kasei Co., Ltd.) | 2 parts |
| Carnauba wax ("CARNAUBA WAX", produced by Nodawax Co., Ltd.) | 12 parts |

The material of the above-described composition was mixed and melt-kneaded using an extruder, pulverized by using a hammer mill or a jet mill, and classified using an air-stream classifier so as to have a mean particle size of 12 μm to obtain a toner for developing static charge images for comparison.

Four (4) parts of each of the toners for developing static charge images according to Examples 1 and 2 of the present invention and comparative toners according to Comparative Examples 1 to 4 were mixed with 96 parts of an iron powder carrier ("FL-1020A", produced by POWDERTECH CO., LTD.) to prepare a developer. Using the toner and developers, the following tests were conducted.

(1) Fixing strength

Toner images were fixed by using a fixing device comprising a hot roller whose surface layer was formed of TEFLON and a press roller whose surface layer was formed of silicone rubber, changing the temperature of the hot roller to predetermined temperatures of 160° C., 170° C., 180° C. and 190° C. gradually and passing at each predetermined temperature sample toners which had been transferred on transfer paper through a commercially available copier. Then, the thus-formed fixed images were rubbed by using a fastness tester. Assuming that the density of the image after the rubbing is A and that of the image before the rubbing is B, value C (%) calculated according to the following equation was defined as fixing strength at each predetermined temperature.

$$A/B \times 100 = C\ (\%)$$

(2) Storage Stability

After dipping a bottle containing 20 g of a sample toner in a water bath kept at a water temperature of 50° C. for 8 hours, the sample toner was shaked for 10 seconds on a 470 μm-mesh sieve by using a powder tester, and the weight of aggregated sample toner which remained on the sieve was defined as a value for evaluating the storage stability of the toner. (3) Under the environmental conditions shown in Table 1 below, the above-described developer was used to conduct continuous copying test until 50,000 sheets were copied using a commercially available copier (BD-3110 produced by Toshiba Limited), and the amount of friction charge generated which was measured by using a blow-off friction charge tester (produced by Toshiba Chemical Co., Ltd.) was defined as environment-dependent characteristics.

TABLE 1

| Indication Method | Envirnmental Conditions: Temperature and Humidity — Temperature (°C.) | Humidity (%) |
|---|---|---|
| N/N | 20 | 60 |
| L/L | 5 | 10 |
| H/H | 35 | 85 |

Of the above items, results on fixing strength, on the storage stability and those on the environmental characteristics are shown in FIGS. 2 and 3, respectively.

TABLE 2

| Fixing Strength and Storage Stability | Fixing Strength (%) 160° C. | 170° C. | 180° C. | 190° C. | Storage Stability (g) |
|---|---|---|---|---|---|
| Example 1 | 73 | 85 | 91 | 100 | 0.85 |
| Example 2 | 74 | 86 | 93 | 100 | 0.80 |
| Com. Ex. 1 | 52 | 64 | 72 | 88 | 0.81 |
| Com. Ex. 2 | 75 | 84 | 90 | 100 | 7.5 |
| Com. Ex. 3 | 52 | 64 | 72 | 88 | 0.82 |
| Com. Ex. 4 | 72 | 80 | 92 | 98 | 6.8 |

TABLE 3-1

| Environmental Characteristics | Environmental Condition | Initial Stage | After 15000 sheets | After 30000 sheets | After 40000 sheets | After 50000 sheets |
|---|---|---|---|---|---|---|
| Example 1 | N/N | 10.4 | 10.2 | 10.6 | 11.0 | 10.8 |
| | L/L | 10.6 | 10.8 | 10.8 | 10.9 | 11.0 |
| | H/H | 10.2 | 9.8 | 9.9 | 9.7 | 9.8 |
| Example 2 | N/N | 10.6 | 10.8 | 10.9 | 10.7 | 10.9 |
| | L/L | 10.9 | 10.9 | 11.1 | 11.2 | 11.0 |
| | H/H | 10.5 | 10.0 | 9.8 | 9.9 | 10.1 |
| Com Ex. 1 | N/N | 10.6 | 10.5 | 10.9 | 11.3 | 11.0 |
| | L/L | 10.8 | 11.2 | 11.3 | 11.3 | 11.6 |
| | H/H | 10.1 | 9.8 | 9.9 | 9.7 | 9.7 |
| Com. Ex 2 | N/N | 10.4 | 10.6 | 11.4 | 11.6 | 11.9 |
| | L/L | 10.7 | 11.6 | 12.0 | 12.8 | 13.6 |
| | H/H | 10.2 | 9.0 | 8.8 | 8.2 | 8.0 |
| Com. Ex. 3 | N/N | 10.8 | 11.1 | 11.2 | 10.9 | 10.9 |
| | L/L | 10.9 | 11.3 | 11.4 | 11.4 | 11.5 |
| | H/H | 10.5 | 10.0 | 10.2 | 9.8 | 10.1 |
| Com. Ex. 4 | N/N | 10.4 | 10.8 | 11.2 | 11.4 | 11.1 |
| | L/L | 10.7 | 11.9 | 12.0 | 12.5 | 13.0 |
| | H/H | 10.4 | 9.4 | 9.0 | 8.8 | 8.0 |

As will be apparent from the results shown in Tables 2 and 3, the toner for developing static charge images according to the present invention had no problem in the storage stability, achieved a fixing strength of 80% which is practically indispensable at a low temperature as low as 170° C., and exhibited a stable friction charge amount for all the environmental conditions. On the other hand, comparative examples 1 and 3 showed a weak fixing strength at low temperatures and comparative examples 2 and 4 showed not only a poor storage stability but also a poor stability of friction charge amount under L/L and H/H conditions.

The invention has been described in detail with respect to embodiments, and it will now be apparent from the foregoing to those skilled in the art that changes and modifications may be made without departing from the invention in its broader aspects, and it is the invention, therefore, in the appended claims to cover all such changes and modifications as fall with the true spirit of the invention.

What is claimed is:

1. A toner for developing static charge images comprising 1–15 parts by weight of natural wax, which wax consists essentially of a fatty acid ester which is insoluble in water and having a DSC heat absorption region at a temperature of greater than or equal to 50° C. and containing fatty acid impurities, said impurities having a DSC heat absorption region at a temperature less than 50° C., wherein said wax has been purified by removal of said fatty acid impurities whose heat absorption regions exist at a temperature less than 50° C., and 100 parts by weight of a binder resin.

2. A toner for developing static charge images as claimed in claim 1, wherein said binder resin is at least one resin selected from the group consisting of polystyrene, styrene/acrylics, polyacrylate, polyethylene, styrene/butadiene copolymer, polyamide, polyvinyl chloride, vinyl chloride/vinyl acetate copolymer and polyester.

3. A toner for developing static charge images as claimed in claim 2, wherein said binder resin is at least one resin selected from the group consisting of styrene/acrylics, polyester.

4. A toner for developing static charge images as claimed in claim 1, wherein said toner further comprises a colorant.

5. A toner for developing static charge images as claimed in claim 4, wherein said colorant is selected from the group consisting of carbon black, nigrosine dye, aniline dye, Chrome Yellow, Ultramarine Blue, Methylene Blue Chloride, Rose Bengale, magnetite and ferrite.

6. A toner for developing static charge images as claimed in claim 1, wherein said toner further comprises an charge control agent, an antioxidant and a flowability improving agent.

7. A toner for developing static charge images as claimed in claim 6, wherein said flowability improving agent is selected from the group consisting of colloidal silica and colloidal alumina.

* * * * *